US009011108B2

(12) United States Patent
Zhao et al.

(10) Patent No.: US 9,011,108 B2
(45) Date of Patent: Apr. 21, 2015

(54) INTELLIGENT ONLINE CLOSED-LOOP BALANCE ADJUSTING SYSTEM FOR PUMPING UNIT

(75) Inventors: Min Zhao, Xi'an (CN); Lianxian Xing, Xi'an (CN)

(73) Assignee: Bode Energy Equipment Co., Ltd, Xi'an, Shanxi (CN)

( * ) Notice: Subject to any disclaimer, the term of this patent is extended or adjusted under 35 U.S.C. 154(b) by 0 days.

(21) Appl. No.: 13/377,759

(22) PCT Filed: Dec. 31, 2010

(86) PCT No.: PCT/CN2010/080587

§ 371 (c)(1),
(2), (4) Date: Dec. 12, 2011

(87) PCT Pub. No.: WO2012/088709

PCT Pub. Date: Jul. 5, 2012

(65) Prior Publication Data

US 2013/0272897 A1 Oct. 17, 2013

(30) Foreign Application Priority Data

Dec. 29, 2010 (CN) ..... 2010 1 0612679

(51) Int. Cl.
*F04B 49/00* (2006.01)
*E21B 43/12* (2006.01)
*F04B 47/02* (2006.01)

(52) U.S. Cl.
CPC ..... *F04B 49/00* (2013.01); *E21B 43/127* (2013.01); *F04B 47/022* (2013.01)

(58) Field of Classification Search
CPC ..... F04B 47/14; F04B 47/22; F04B 47/28; F04B 49/00; E21B 43/127
USPC ..... 417/218, 212
See application file for complete search history.

(56) References Cited

U.S. PATENT DOCUMENTS 3,793,904 A * 2/1974 Grable ..... 74/590
5,528,947 A * 6/1996 Wang et al. ..... 74/41

FOREIGN PATENT DOCUMENTS

| | | |
|---|---|---|
| CN | 2352723 | 12/1999 |
| CN | 2513279 | 9/2002 |
| CN | 201050348 | 4/2008 |
| CN | 201092848 | 7/2008 |
| CN | 201103383 | 8/2008 |
| CN | 201934067 U | 8/2011 |

OTHER PUBLICATIONS

International Search Report from corresponding PCT Application No. PCT/CN2010/070591, mailed Sep. 1, 2011, 10 pages.

* cited by examiner

*Primary Examiner* — Charles Freay
*Assistant Examiner* — Philip Stimpert
(74) *Attorney, Agent, or Firm* — Shumaker & Sieffert, P.A.

(57) ABSTRACT

The invention relates to an intelligent online closed-loop balance adjusting system for a pumping unit. The system comprises a connecting rod, balance weights, a transmission device, a balance weight displacement adjusting motor and a control device used for driving the motor to adjust and control the weight displacement. The transmission device and the balance weight displacement adjusting motor are arranged above a walking beam. The balance weight displacement adjusting motor is connected with one end of the connecting rod through the transmission device, and the other end of the connecting rod is connected with balance weights. One end of the walking beam away from the horse-head is connected with the middle part of the connecting rod. The invention can realize automatic weight adjustment without shutting the machine down, and the balance weights can be adjusted with the precision of ±10%.

9 Claims, 2 Drawing Sheets

INTELLIGENT ONLINE CLOSED-LOOP BALANCE ADJUSTING SYSTEM FOR PUMPING UNIT

TECHNICAL FIELD OF THE INVENTION

The invention relates to the structure and control of an automatic balance adjusting system for a pumping unit, in particular to an intelligent online closed-loop balance adjusting system for a pumping unit.

BACKGROUND OF THE INVENTION

A pumping unit is the most common ground equipment in an oil extraction equipment used in the oil field. The pumping unit realizes oil pumping by controlling a horse-head on a walking beam to move upward and downward. During the oil pumping, the balance between balance weights and the horse-head should be controlled. If unbalance occurs, energy of a dragging motor for dragging the walking beam will be lost. If the unbalance is serious, it may cause the horse-head out of control.

At present, the balance of the pumping unit is adjusted by increasing or decreasing the number of balance weights on the balancing element below the pumping unit. The method may have the following defects: first, balance weights are easy to lose; second, balance weights have to be transported manually, and the labor intensity is large; third, balance weight adjustment is not precise; and fourth, it is necessary to execute adjustment after shutting the machine down.

At present, there is still no effective method to realize balance adjustment conveniently and automatically.

SUMMARY OF THE INVENTION

In order to solve the technical problem of the traditional art, the invention provides an intelligent online closed-loop balance adjusting system for a pumping unit. The invention can realize automatic balance weight adjustment without shutting the machine down, and the balance weights can be adjusted with the precision of ±10%.

The technical solution of the invention is as follows: the invention relates to an intelligent online closed-loop balance adjusting system for a pumping unit, wherein the system comprises a connecting rod, balance weights, a transmission device, a balance weight displacement adjusting motor and a control device used for driving the motor to adjust and control the displacement of the balance weights, the transmission device and the balance weight displacement adjusting motor are arranged above a walking beam, the balance weight displacement adjusting motor is connected with one end of the connecting rod through the transmission device, the other end of the connecting rod is connected with balance weights, and one end of the walking beam away from the horse-head is connected with the middle part of the connecting rod.

The system further comprises a first coupling, a second coupling and a support and thrust bearing, and the balance weight displacement adjusting motor is connected with the transmission device through the first coupling, the support and thrust bearing and the second coupling in turn.

The system further comprises a hinge soleplate and a hinge bracket, the balance weight displacement adjusting motor and the support and thrust bearing are arranged on the hinge soleplate, the hinge bracket is arranged above the walking beam, and the hinge soleplate is hinged with the hinge bracket through a second hinge.

The transmission device is a lead screw transmission device, the lead screw transmission device comprises a lead screw and a nut, and the support and thrust bearing is connected with one end of the connecting rod through the second coupling, the lead screw and the nuts.

The nuts are hinged with the connecting rod through a first hinge.

The end of the walking beam away from the horse-head is hinged with the middle part of the connecting rod through a third hinge.

The control device comprises a current detector for detecting the current of the driving motor and a displacement adjusting motor controller for controlling the balance weight displacement adjusting motor, and the current detector is connected with the displacement adjusting motor controller.

The control device further comprises an angular displacement sensor for detecting the position and the operating direction of the horse-head, the angular displacement sensor is arranged at the connection position between the walking beam and the walking beam bracket, and the angular displacement sensor is connected with the displacement adjusting motor controller.

The control device further comprises a controller, and the angular displacement sensor is connected with the displacement adjusting motor controller through the controller.

The displacement adjusting motor controller is a single chip machine.

The controller is a single chip machine.

The invention has the following advantages:

1. the simple structure: the invention can be obtained by newly manufacturing the system or by modifying a traditional walking beam type oil pumping machine.

2. the reliable operation: the balance weight displacement adjusting motor, the decelerator, the couplings, the support and thrust bearing, the lead screw and the nut in the invention form a connecting rod mechanism, so the operation is stable and reliable.

3. the simple and reliable system adjustment: the mathematical model of the system adjustment in the invention is quite simple, and iterative approximation using the formula can be utilized to obtain the best working point.

4. the online real-time adjustment: the adjustment process of the invention is an online real-time adjustment which can be performed without shutting the machine down, so that the working efficiency is improved.

5. the decreased labor intensity: the adjustment process in the invention is an automatic adjustment performed by a motor and no manual intervention is needed, so that manual labor is eliminated.

6. the reduced operation cost: owing to the online automatic adjustment and no manual intervention needed, the present invention reduces the number and the labor intensity of maintenance personnel.

7. the decreased energy consumption: the present invention assures the pumping unit operating under a balanced condition, and the energy consumption of the motor is lowest.

1—Balance weight displacement adjusting motor, 21—First coupling, 22—Second coupling, 3—Support and thrust bearing, 4—Lead screw, 5—Nut, 61—First hinge, 62—Second hinge, 63—Third hinge, 64—Fourth hinge, 7—Connecting rod, 8—Balance weight, 9—Hinge soleplate, 10—Hinge bracket, 11—Horse-head, 12—Angular displacement sensor, 13—Walking beam, 14—Driving motor, 15—Walking beam bracket, 16—Current detector, 17—Displacement adjusting motor controller, 18—Controller, 19—Hollow connecting rod

DETAILED DESCRIPTION OF THE INVENTION

Figure 1:
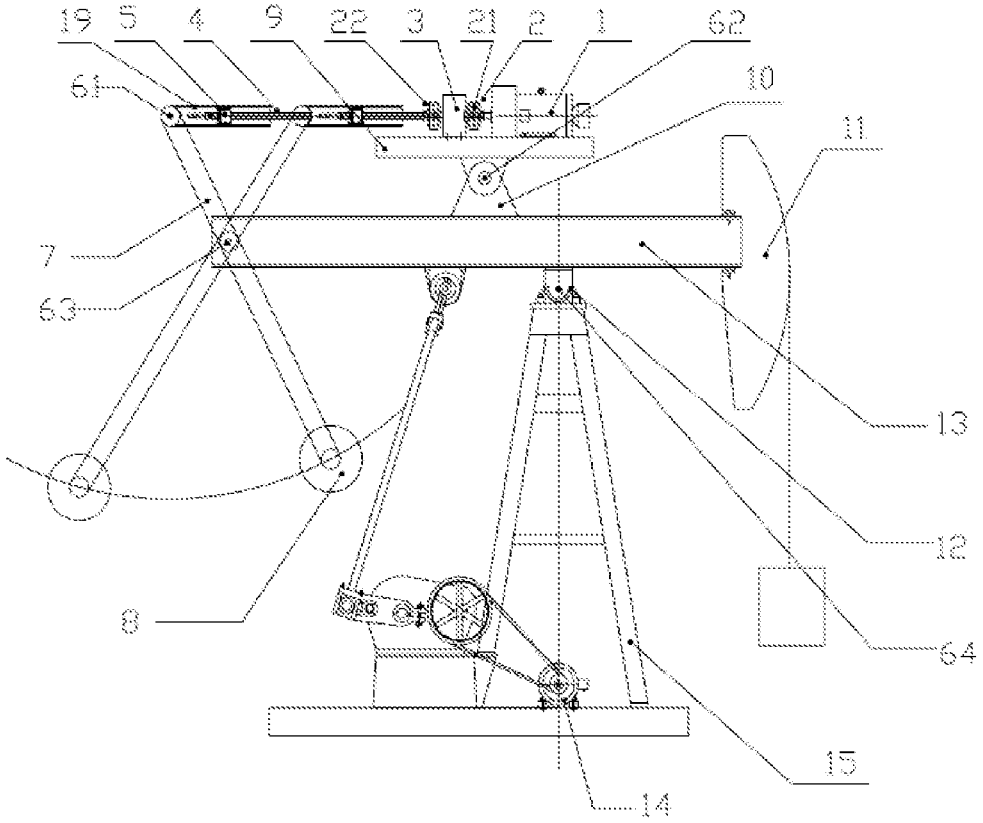
FIG. 1 shows a structural schematic view of a particular application embodiment of the invention.
Figure 2:
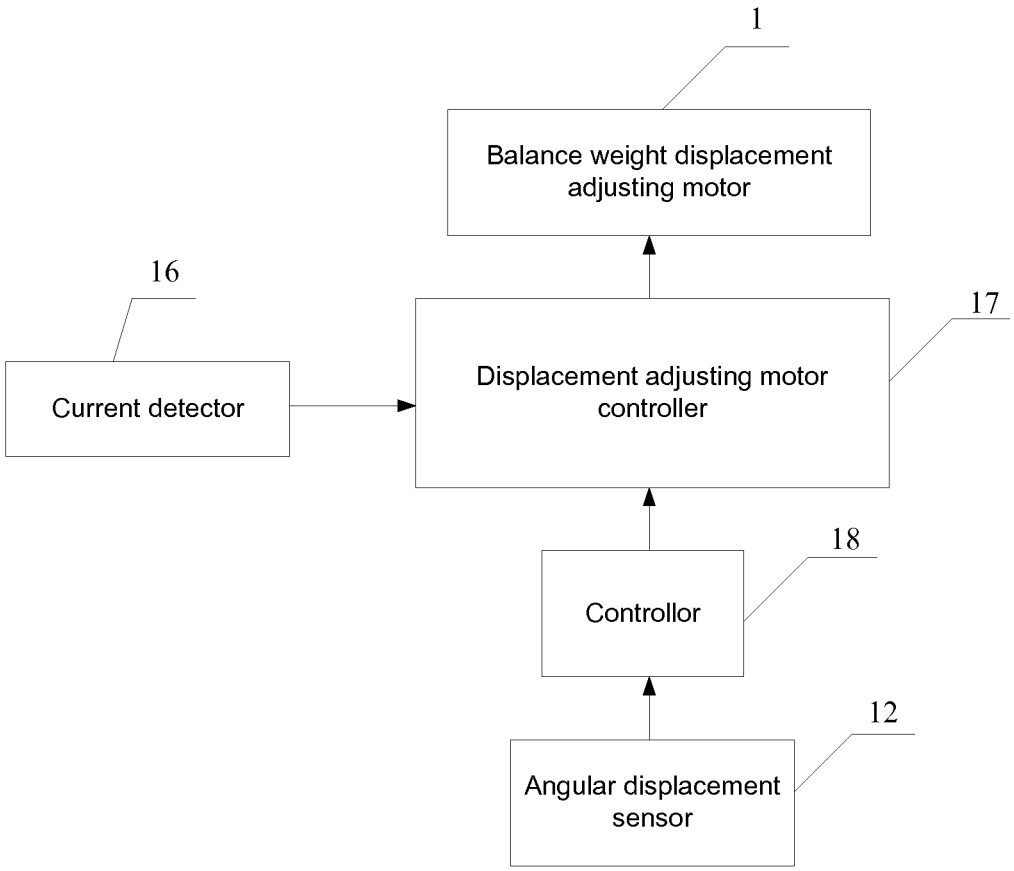
FIG. 2 shows a principle block diagram of a control device of a particular application embodiment of the invention.

With reference to FIG. 1 and FIG. 2, the particular application embodiment of the invention has the structure comprising a balance weight displacement adjusting motor 1, a first coupling 21, a second coupling 22, a support and thrust bearing 3, a connecting rod 7, balance weights 8, a hinge soleplate 9, a hinge bracket 10, a transmission device and a control device used for driving the motor to adjust and control the weight displacement. The balance weight displacement adjusting motor 1 is connected with the transmission device through the first coupling 21, the support and thrust bearing 3, and the second coupling 22 in turn. The transmission device is connected with one end of the connecting rod 7, and the other end of the connecting rod 7 is connected with balance weights 8. The end of the walking beam 13 away from the horse-head 11 is hinged with the middle part of the connecting rod 7 through a third hinge 63. The transmission device in the invention is a lead screw transmission device, which comprises a lead screw 4 and a nut 5. The support and thrust bearing 3 is connected with one end of the connecting rod 7 through the second coupling 22, the lead screw 4 and the nut 5. The nut 5 is hinged with the connecting rod 7 through a first hinge 61. In the particular embodiment of the invention, the nut 5 is arranged in a hollow connecting rod 19. The nut 5 is welded in the hollow connecting rod 19, and the end of the hollow connecting rod 19 away from the nut is hinged with the connecting rod through the first hinge 61. The balance weight displacement adjusting motor 1 and the support and thrust bearing 3 are arranged on the hinge soleplate 9, the hinge bracket 10 is arranged above a walking beam 13, and the hinge soleplate 9 is hinged with the hinge bracket 10 through a second hinge 62.

The controller device comprises a current detector 16 for detecting the current of the driving motor 14 and a displacement adjusting motor controller 17 for controlling the balance weight displacement adjusting motor. The current detector 16 is connected with the displacement adjusting motor controller 17. The control device further comprises an angular displacement sensor 12 for detecting the position and the operating direction of the horse-head 11 and a controller 18. The angular displacement sensor 12 is arranged at the connection position between the walking beam 13 and the walking beam bracket 15. The angular displacement sensor 12 is connected with the displacement adjusting motor controller 17 through the controller 18. The displacement adjusting motor controller 17 is a single chip machine and the controller 18 is a single chip machine. The current detector 16 is any existing current detection device, and the angular displacement sensor 12 is any existing sensor that can realize angular displacement measurement.

When the system of the present invention is in operation, the current detector 16 detects the magnitude of current output of the driving motor 14. When the balance weights 8 and the horse-head 11 are unbalanced, the ascend and descend powers of the driving motor 14 are unequal. When the horse-head 11 side is overweight, the ascend power is more than the descend power. Conversely when the horse-head 11 side is underweight, the ascend power is less than the descend power. The displacement adjusting motor controller 17 controls the steering direction of the balance weight displacement adjusting motor 1 according to this principle, and the arm length of adjustment between the balance weight 8 and the fourth hinge 64 (the hinge between the walking beam 13 and the walking beam bracket 15) is increased or decreased. When the balance weight displacement adjusting motor 1 is being rotated, the connecting rod 7 is driven to move leftward and rightward through the decelerator, the first coupling 21, the support and thrust bearing 3, the second coupling 22, the lead screw 4, the nut 5 and the first hinge 6, and the arm length between the balance weight 8 and the fourth hinge 64 is adjusted in size, to adjust the balance between the horse-head 11 of the pumping unit and the balance weight 8.

The system adjustment is stopped when the ascend and descend powers meet the following formulas:

$$P_U=P_D(1+P_E) \tag{1}$$

$$-10\%\leq P_E=(P_U-P_D)/(P_U+P_D)\leq+10\% \tag{2}$$

wherein:

$P_U$: output power of the motor when the horse-head ascends;

$P_D$: output power of the motor when the horse-head descends;

$P_E$: difference of the output power of the motor between the horse-head ascending and the horse-head descending.

The system adjustment is stopped when ascend currents and descend currents meet the following formulas:

$$I_U=I_D(1+I_E) \tag{3}$$

$$-10\%\leq I_E=(I_U-I_D)/(I_U+I_D)\leq+10\% \tag{4}$$

wherein:

$I_U$: current of the motor when the horse-head ascends;

$I_D$: current of the motor when the horse-head descends;

$I_E$: difference of the current of the motor between the horse-head ascending and the horse-head descending.

The controller 18 also can detect the position and operating direction of the horse-head 11 through the angular displacement sensor 13, for auxiliary adjustment of the balance between the horse-head 11 of the pumping unit and the balance weight 8.

The invention claimed is:

1. An intelligent online closed-loop balance adjusting system for a pumping unit, wherein the system comprises:

a connecting rod, balance weights, a transmission device, a balance weight displacement adjusting motor and a control device used for driving the motor to adjust and control the displacement of the balance weights, the transmission device and the balance weight displacement adjusting motor are arranged above a walking beam, wherein the balance weight displacement adjusting motor is connected with one end of the connecting rod through the transmission device, the other end of the connecting rod is connected with the balance weights, and one end of the walking beam away from a horse-head is connected with the middle part of the connecting rod, and wherein the system further comprises a first coupling, a second coupling and a support and thrust bearing, and the balance weight displacement adjusting motor being connected with the transmission device through the first coupling, the support and thrust bearing and the second coupling in turn.

2. The intelligent online closed-loop balance adjusting system for a pumping unit according to claim 1, wherein the system further comprises a hinge soleplate and a hinge bracket, the balance weight displacement adjusting motor and the support and thrust bearing are arranged on the hinge soleplate, the hinge bracket is arranged above the walking beam, and the hinge soleplate is hinged with the hinge bracket through a second hinge.

3. The intelligent online closed-loop balance adjusting system for a pumping unit according to claim 2, wherein the transmission device is a lead screw transmission device, the lead screw transmission device comprises a lead screw and a nut, and the support and thrust bearing is connected with one end of the connecting rod through the second coupling, the lead screw and the nut[s].

4. The intelligent online closed-loop balance adjusting system for a pumping unit according to claim 3, wherein the nuts are hinged with the connecting rod through a first hinge.

5. The intelligent online closed-loop balance adjusting system for a pumping unit according to claim 4, wherein the end of the walking beam away from the horse-head is hinged with the middle part of the connecting rod through a third hinge.

6. The intelligent online closed-loop balance adjusting system for a pumping unit according to claim 1, wherein the control device comprises a current detector for detecting the current of the driving motor and a displacement adjusting motor controller for controlling the balance weight displacement adjusting motor, and the current detector is connected with the displacement adjusting motor controller.

7. The intelligent online closed-loop balance adjusting system for a pumping unit according to claim 6, wherein the control device further comprises an angular displacement sensor for detecting the position and the operating direction of the horse-head, the angular displacement sensor is arranged at the connection position between the walking beam and the walking beam bracket, and the angular displacement sensor is connected with the displacement adjusting motor controller.

8. The intelligent online closed-loop balance adjusting system for a pumping unit according to claim 7, wherein the control device further comprises a controller, and the angular displacement sensor is connected with the displacement adjusting motor controller through the controller.

9. The intelligent online closed-loop balance adjusting system for a pumping unit according to claim 7, wherein the displacement adjusting motor controller is a single chip machine and the controller is a single chip machine.

* * * * *